US006976607B2

(12) United States Patent
Benoit-Gonin et al.

(10) Patent No.: US 6,976,607 B2
(45) Date of Patent: Dec. 20, 2005

(54) TAMPER-EVIDENT CLOSURE

(75) Inventors: Claude Benoit-Gonin, Odenas (FR); Didier Bazin, Pont-de-Cheruy (FR)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 44 days.

(21) Appl. No.: 10/470,469

(22) PCT Filed: Jan. 30, 2002

(86) PCT No.: PCT/EP02/00949

§ 371 (c)(1),
(2), (4) Date: Jul. 29, 2003

(87) PCT Pub. No.: WO02/060776

PCT Pub. Date: Aug. 8, 2002

(65) Prior Publication Data

US 2004/0069806 A1 Apr. 15, 2004

(30) Foreign Application Priority Data

Jan. 30, 2001 (FR) ..... 01 01252

(51) Int. Cl.[7] ..... B67D 5/32
(52) U.S. Cl. ..... 222/153.06; 222/153.14; 222/556

(58) Field of Search ..... 222/153.06, 153.14, 222/546, 556

(56) References Cited

U.S. PATENT DOCUMENTS

| | | | | |
|---|---|---|---|---|
| 4,170,315 | A * | 10/1979 | Dubach et al. | 220/281 |
| 4,353,483 | A * | 10/1982 | Pehr | 222/153.02 |
| 4,718,567 | A * | 1/1988 | La Vange | 215/216 |
| 5,141,138 | A * | 8/1992 | Odet et al. | 222/153.07 |
| 5,328,058 | A * | 7/1994 | Leoncavallo et al. | 222/153.14 |
| 5,662,245 | A * | 9/1997 | Grant | 222/153.07 |

* cited by examiner

*Primary Examiner*—Joseph A. Kaufman
(74) *Attorney, Agent, or Firm*—Diller, Ramik & Wight

(57) ABSTRACT

A cap comprising an upper part (2) having a dispensing orifice (10), a skirt (3) which depends from the upper part (2), a lid (15) connected to the upper part by a hinge (16) so as to be movable between open and closed positions of the orifice (10); tamper-evident band (25) joined to the upper part (2) by frangible straps (30, 32) each having a zone of least resistance for rupture, and which defines a hooking edge (26) in the closed position for receiving a hook (27) carried by the lid (15). The lid includes means (35) for retaining the band (25) in order to hold it against the lid (15) in the closed position and to prevent manipulation of the band to open the lid without rupture of the straps.

13 Claims, 4 Drawing Sheets

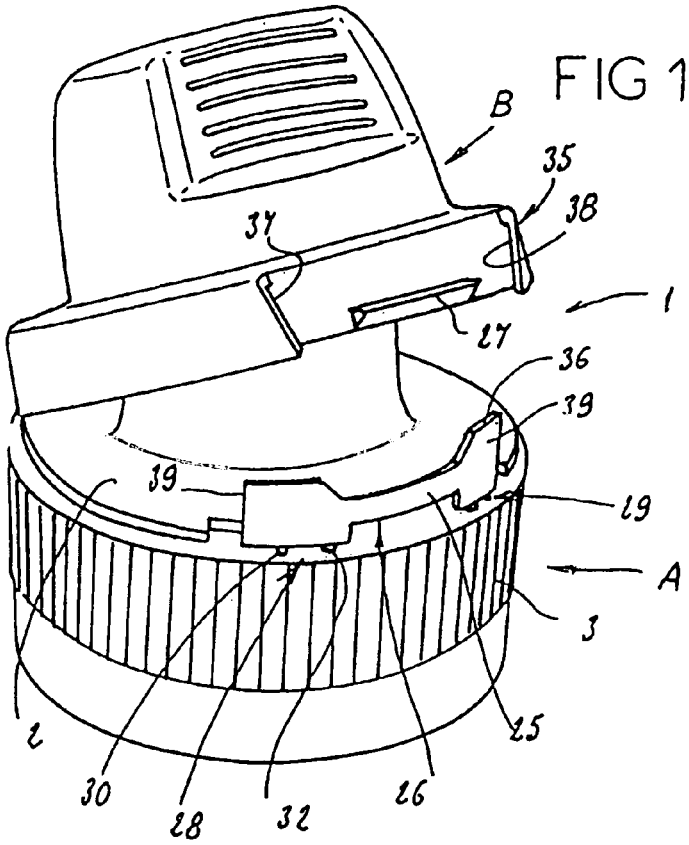
FIG 1
FIG 3
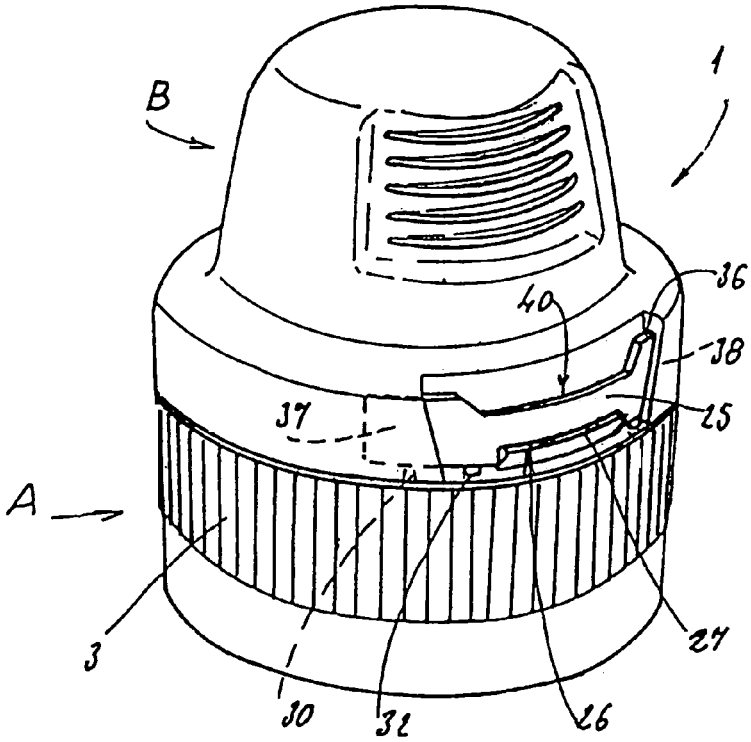

TAMPER-EVIDENT CLOSURE

BACKGROUND OF THE INVENTION

The invention concerns the technical field of caps with a dispensing orifice for closing the neck of a container.

In the above field, for closing a container having a neck, for example a bottle made of plastics material designed to contain water, it is known to use a cap made of plastics material which comprises an upper part having a dispensing orifice for dispensing the contents of the bottle. The cap also comprises a substantially cylindrical skirt extending from the upper part and having on an inner face means of fixing it on to the neck of the bottle. In order to be able to ensure closure of the dispensing orifice, the cap comprises in addition a lid connected to the upper part by at least one hinge in order to be movable between an open position and a closed position of the dispensing orifice. Insofar as it is desirable to be able to ensure the integrity of the contents of the bottle before its first opening, the cap comprises in addition a tamper-evident band generally situated opposite the hinge and connected to the upper part of the cap by at least two frangible straps each having a zone of least resistance for rupture. The tamper-evident band then defines a hooking edge for a hook carried by the lid.

More often than not, such a cap is made of plastics material injected in a mould which allows a monobloc cap to be obtained with an open configuration of the lid of the dispensing orifice. Thus, before first use of the cap, the lid is placed in the closed position covering the dispensing orifice, a position in which the hook of the lid is engaged under the hooking edge defined by the tamper-evident band.

A cap such as the above enables the hermetic closure of a container to be ensured while more often than not guaranteeing the integrity of the contents of the container before first opening of the lid of the cap.

However, in certain conditions it has appeared possible to disengage the hook of the lid from the tamper-evident band. In known such caps the tamper-evident band is exposed along its entire length, and is not held on the upper part of the cap other than by the frangible straps. Because access is possible to the entire length of the band and because it is not held against the closure it is relatively easy to defeat the tamper-evidence by gently stretching and/or manipulating the band, for example by inclining it away from its normal more or less vertical position, so that it can pass over the hook without breaking the frangible straps. Thus, it is possible to open the lid without breaking the straps connecting the tamper-evident band to he upper part of the cap. The tamper-evident band therefore no longer fulfils its function of guarantee for the integrity of the contents of the container onto which the cap is fitted.

Therefore there appears to be a need to have a cap whose tamper-proof system, comprising the hook of the lid and the tamper-evident band under which the hook is engaged, can guarantee the integrity of the contents of the container more effectively than the caps according to the prior art, by ensuring that any opening of the lid necessarily leads to a rupture of at least one of the connecting straps between the band and the upper part of the cap.

Moreover, after the first opening of a cap according to the prior art, the user has to get rid of the tamper-evident band, which is no longer of any use to him. So, apart from leaving the tamper-evident band on the ground, the user has to have at his disposal means for temporarily storing the tamper-evident band or a dustbin. The user does not always have such means at his disposal.

Therefore there appears to be a need to have a cap which gives a solution to this problem and relieves the user of the necessity of finding a means of getting rid of the tamper-evident band.

SUMMARY OF THE INVENTION

In order to achieve these objectives, the invention concerns a cap with a dispensing orifice for closing the neck of a container, comprising:

- an upper part having a dispensing orifice for dispensing the contents of the container;
- a skirt depending from the upper part and having means for fixing the cap onto the neck of the container,
- a lid connected to the upper part by at least one hinge in order to be movable between open and closed positions of the dispensing orifice;
- a tamper-evident band which is joined to the upper part of the cap by at least two frangible straps each having a zone of least resistance for rupture, and which defines a hooking edge for receiving a hook carried by the lid (in the closed position of the orifice).

According to the invention the cap is characterised in that the lid includes means for retaining the tamper-evident band in order to hold it against the lid in the closed position of the orifice and to prevent manipulation of the band to open the lid without rupture of the straps.

According to a characteristic of the invention, the retaining means are adapted to receive at least part of the edge of the band situated opposite the hooking edge in order to hold the band on the lid after a rupture of the straps following a first opening of the cap. The retaining means therefore serve a dual purpose. First, they help to prevent manipulation of the band aimed at defeating the tamper-evidence. Second, they retain the band on the cap after first opening.

According to another preferred but not strictly necessary characteristic of the invention, the retaining means comprise at least one and preferably two seats for receiving at least a part of the tamper-evident band in order, in association with the hook of the lid, to retain the tamper-evident band on the lid after a rupture of the straps following a first opening of the cap. Preferably, the two seats each then receive, on the one hand, a part of the edge of the band situated adjacent the hooking edge and, on the other hand, an extreme edge of the tamper-evident band.

According to yet another characteristic of the invention, the retaining means comprise at least one groove designed to receive a part at least of the edge of the tamper-evident band situated opposite the hooking edge, when the hook of the lid is engaged under the hooking edge.

According to another characteristic of the invention, the retaining means comprise at least one tab which fits a part of the edge of the tamper-evident band.

According to another characteristic of the invention, in order to facilitate engagement of the retaining means on the tamper-evident band at the time of first opening of the lid, the tamper-evident band comprises a notch arranged in the edge of the band situated opposite the hooking edge.

According to another characteristic of the invention, the tamper-evident band has a notch level with the hooking edge. According to another characteristic of the invention, the tamper-evident band comprises a window, the edge of which defines the hooking edge of the hook of the lid.

Various other characteristics of the invention are described below with reference to the attached drawings, which show non-limiting embodiments of a cap according to the invention.

BRIEF DESCRIPTION OF THE DRAWINGS

FIG. 1 is a perspective view showing a cap according to the invention in the semi-open position of the cap before first closure.

FIG. 3 is a perspective view analogous to FIG. 1 showing the cap in the fully closed position of the lid before first opening.

DETAILED DESCRIPTION OF THE PREFERRED EMBODIMENTS

Figure 2:
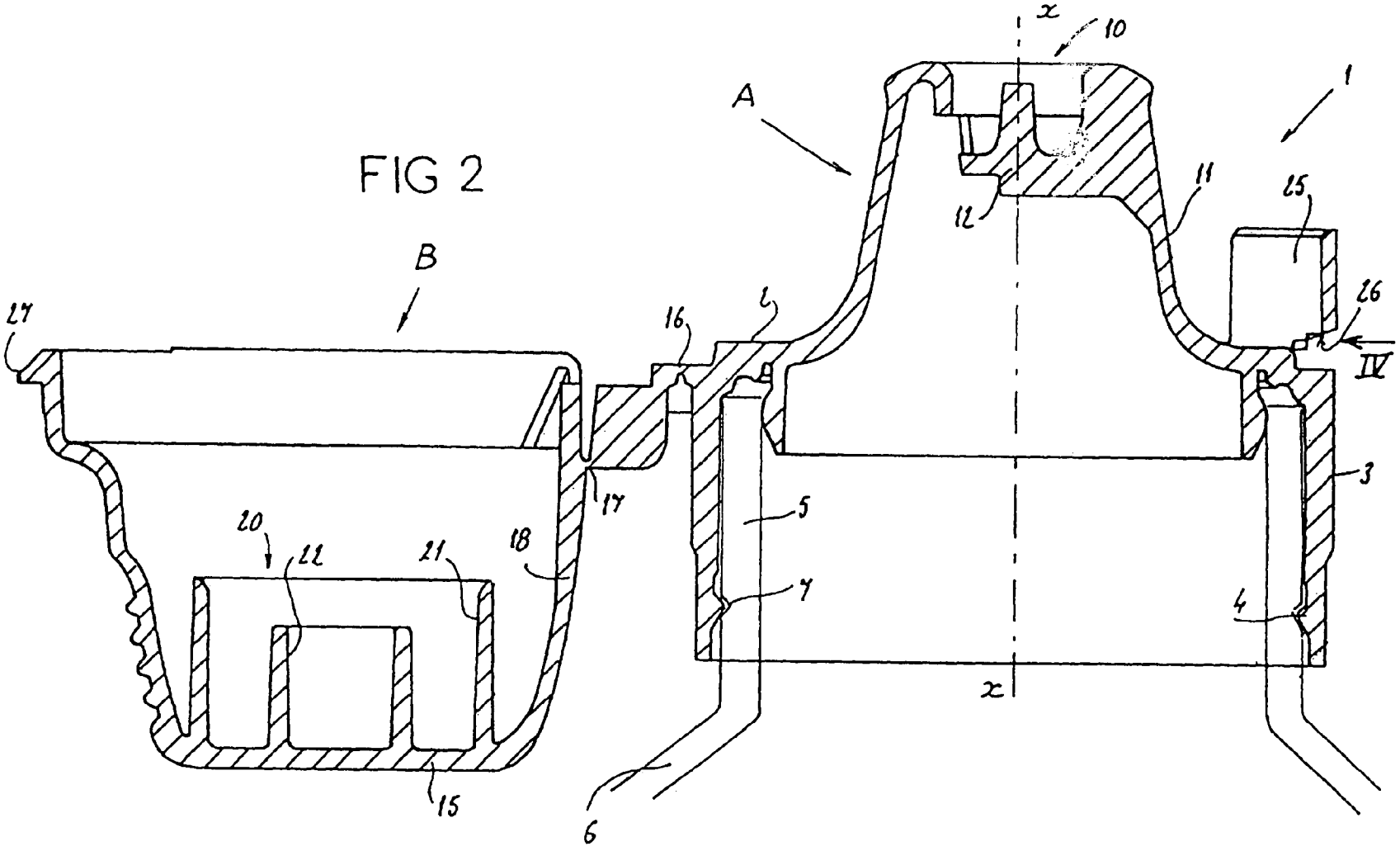
FIG. 2 is an axial section of the cap illustrated in FIG. 1 in the fully open position of the lid, such as the cap obtained on leaving the mould.

As emerges from FIGS. 1 to 4, a cap according to the invention, designated as a whole by the reference 1, comprises a pourer part A and a lid part B. The pourer part A comprises an upper part 2 from which extends a skirt 3 of more or less cylindrical shape with respect to the main longitudinal axis X–X' (see FIG. 2). The skirt 3 has, on its inner face, means 4 for fixing the cap 1 on to a neck 5 of a container 6. The means 4 for fixing the skirt 3 are designed to co-operate with complementary means 7 offered by the outer face of the neck 5. The fixing means 4 and 7 can be realised in any appropriate way and, according to the example illustrated, are constituted by a rib 4 of the skirt 3 designed to snap into a complementary groove 7 of the neck. Of course, the fixing means 4 and 7 could be realised in any other way such as, for example, one or several helical threads allowing screwing of the cap 1 on to the neck 5.

A dispensing orifice 10 is arranged in the upper part 2 in order to allow dispensing of the contents of the container 6. According to the example illustrated, the dispensing orifice 10 is defined by a collar 1 extending from the upper part 2 opposite the skirt 3. According to the example illustrated, the orifice 10 is equipped with an anti-splash device 12.

The cap 1 comprises in addition a lid 15 connected to the upper part 2, level with a joining edge between the upper part 2 and the skirt 3, by at least one hinge and, according to the example illustrated, two hinges 16 and 17. The lid 15 is thereby movable between an open position of the orifice 10 as illustrated in FIG. 2 and a closed position of closure of the orifice 10 such as illustrated more particularly in FIG. 3. In a preferred way, the lid 15 is equipped, on its inner face 18, with means 20 designed to ensure a more or less tight closure of the orifice 10. According to the example illustrated, the means 20 are formed by two concentric closure skirts 21 and 22 designed to co-operate with the inner and outer edges of the collar 11.

In order to allow a user of the container 6, closed by means of the cap 1 in conformity with the invention, to be sure of the integrity of the contents of the container 6, the cap 1 also comprises a tamper-evident band 25 which defines a hooking edge 26 for a hook 27 arranged on the outer face of the lid 15. The hook 27 is arranged on the lid 15 opposite the hinges 16 and 17 while the band 25 is situated bordering on the edge of the upper part 2 also opposite the hinges 16 and 17. The band 25 extends, moreover, over one side only of the circumference of the upper part.

As emerges from FIG. 1, the tamper-evident band 25 is connected to the edge of the upper part 2 by two series of divisible straps 28 and 29 on either side of the hooking edge 26. Each series 28 and 29 comprises at least two divisible straps, of which one 30, the outer strap, is situated close to one end 39 of the band 25 and a second 32, the inner strap, is situated close to the hooking edge 26.

In accordance with one characteristic of the invention, in order to avoid a loss of the tamper-evident band 25 after rupture of the straps, the lid 15 comprises means 35 for retaining the tamper-evident band in order to hold the band on the lid after a rupture of the straps 30, 32 following a first opening of the cap. The means 35 for retaining the tamper-evident band can be realised in any appropriate way. Preferably the means 35 partly receive at least the edge 36 of the tamper-evident band 25 situated opposite the hooking edge 26. According to the example illustrated, the retaining means comprise two seats 37, 38, which are situated on either side of the hook 27. Each seat 37, 38 is designed to receive an end of the tamper-evident band. So, each seat 37 or 38 fits a part of the edge 36 of the band situated opposite hooking the edge 26 as well as a far edge 39 of the tamper-evident band. The retaining means 35, formed by the two lateral seats 38 and 37, ensure their function of retaining the tamper-evident band 25 in the following way.

In a way known to the man skilled in the art and therefore not necessitating a fuller description, the cap in conformity with the invention is made of plastics material by injection moulding in the open configuration illustrated in FIG. 2. After removal from the mould and before use of the cap, the lid is placed in closed position of the orifice 10 such as illustrated in FIG. 3 in which the hook 27 is engaged under the edge 26 of the tamper-evident band.

At the time of first closure, the seats 37 and 38 engage on the ends 39 of the tamper-evident band. In order to facilitate this engagement, in a preferred but not strictly necessary way, the edge 36 of the tamper-evident band has a notch 40 which allows the ends of the tamper-evident band 25 to begin to engage in the seats 37 and 38 before the hook 27 comes to rest on the tamper-evident band in the course of the descent of the lid 15 towards the upper part 2. After complete closure of the lid 15, the tamper-evident band 25 is, on the one hand, connected to the upper part 2 by the straps 30 and 32 and, on the other hand, immobilised in the seats 37 and 38 in such a way that it is not possible to pull down the tamper-evident band towards the front in the direction of the arrow F1 in order to try to open the lid 15 without rupture of the straps.

Figure 6:
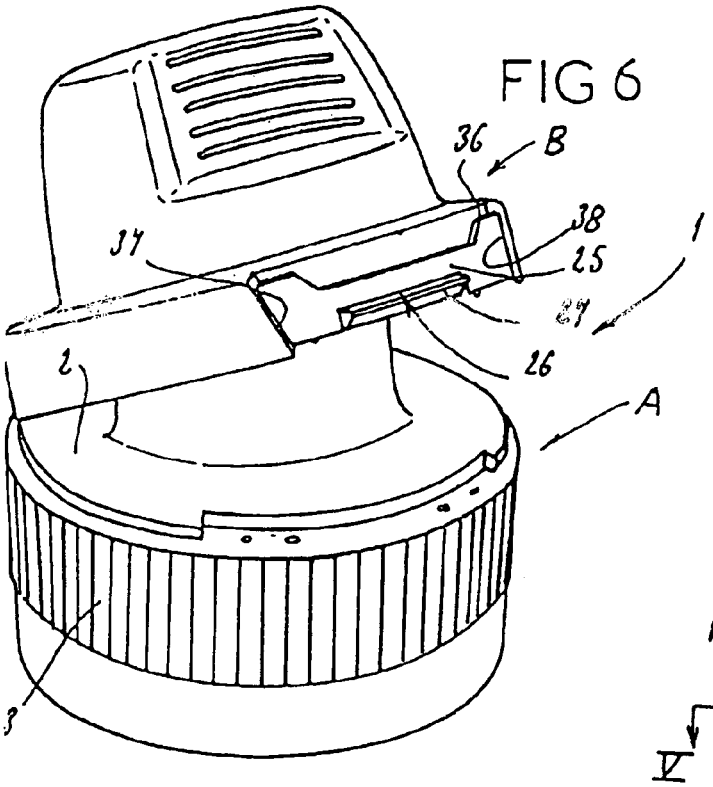
FIG. 6 is a perspective view showing the cap according to FIG. 3 after first opening and rupture of the frangible straps connecting the tamper-evident band to the upper part of the cap.
Figure 4:
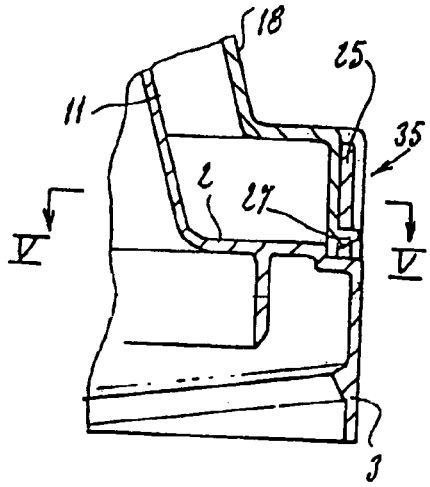
FIG. 4 is a partial axial section of the cap illustrated in FIG. 3.
Figure 5:
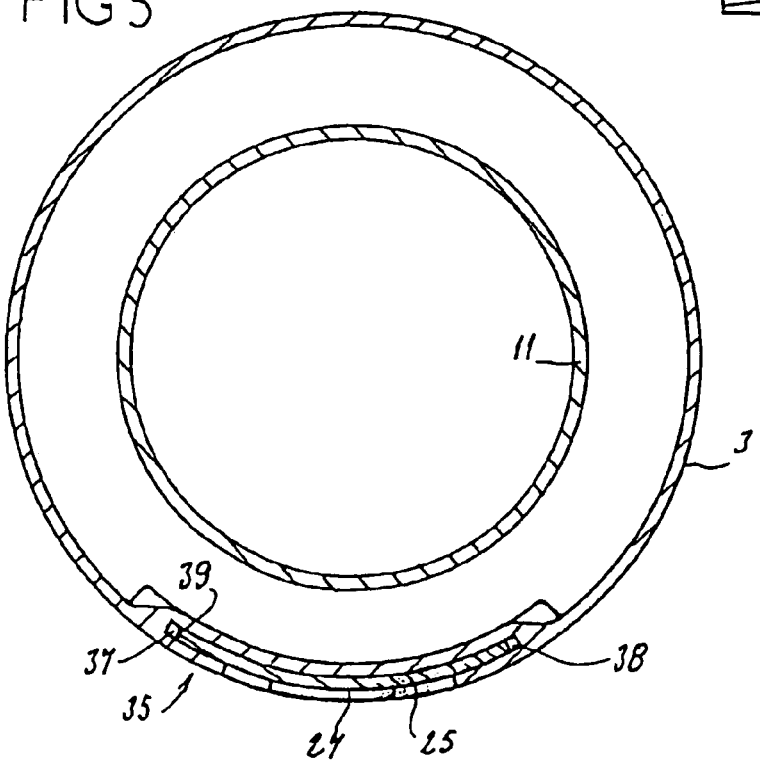
FIG. 5 is a transverse section along the line V—V of FIG. 4.

The closure of the present invention therefore restricts the ability to manipulate the band, first by physically restraining its movement, and second by restricting the area of the band that can be accessed. Moreover, after a first opening of the cap according to the invention by rupture of the divisible straps 30 and 32, the tamper-evident band remains attached to the lid 15 as shown in FIG. 6. In fact, the ends 39 of the tamper-evident band are immobilised in the seats 37 and 38 while the hooking edge remains resting on the hook 27 of the lid. In this way, the tamper-evident band remains attached to the lid 15, so that the question of its being taken care of or its storage no longer arises for a user of the cap. It should be noted that the immobilisation of the tamper-evident band results, on the one hand from the resting of the hooking edge 26 on the hook 27 and, on the other hand, from a resting of the edge 36 of the tamper-evident band 25 against the edges of the seats 37 and 38.

Of course, it would be possible to consider realising the retaining means 35 in another form.

Figure 7:
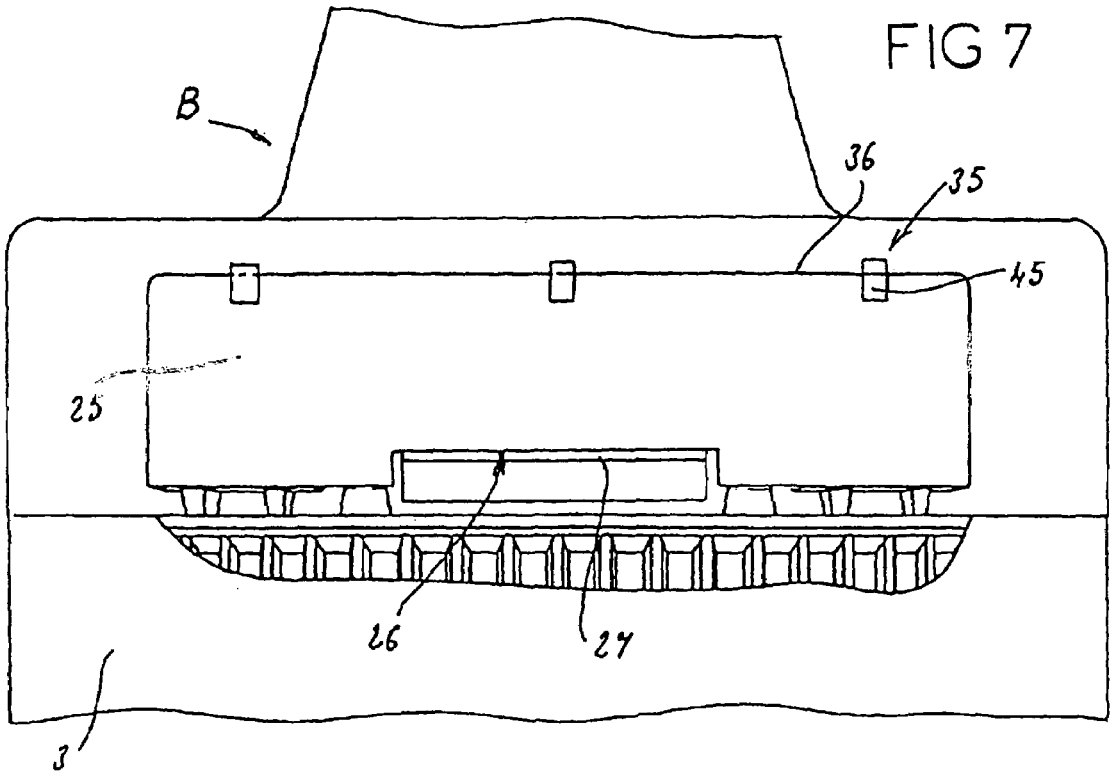
FIGS. 7 and 8 are partial front elevations of the cap according to the invention showing other embodiments of the retaining means of the tamper-evident band.

FIG. 7 illustrates an embodiment according to which the retaining means 35 are constituted by at least one, and according to the example illustrated, three tabs 45 which fit over the upper edge 36 of the tamper-evident band. Thus, the retaining means 35 hold the band 25 against the lid 15 in the closed position of the orifice and prevent movement of the band 25 towards the front in order to try to release the hook 27 without rupture of the straps. It should be noted that, according to this example, the top edge of the tamper-evident band is not notched. Moreover, providing tabs on the sides of the band 25 could also be considered.

Figure 8:
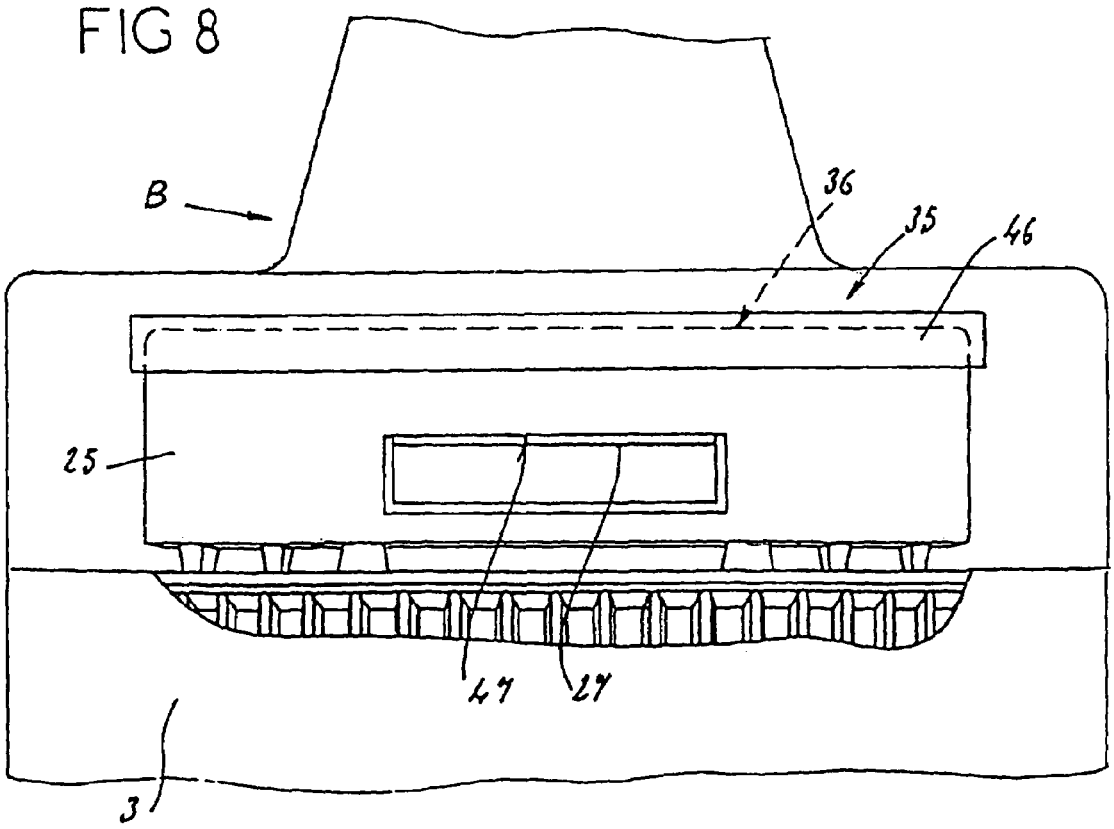

In the same way, FIG. 8 illustrates an embodiment of the retaining means according to which the latter are constituted by a continuous groove 46 fitting the upper edge 36 of the tamper-evident band.

According to this example, it must also be noted that the tamper-evident band 25 has a window 47 into which the hook 27 is inserted, the top edge of the window defining the hooking edge 26 for the hook 27.

In the examples above the skirt 23 does not include a tamper-evident band, which of course it could.

Although a preferred embodiment of the invention has been specifically illustrated and described herein, it is to be understood that minor variations may be made in the apparatus without departing from the spirit and scope of the invention, as defined by the appended claims.

What is claimed is:

1. A cap with a dispensing orifice for closing a neck (5) of a container (6), comprising:

an upper part (2) having a dispensing orifice (10) for dispensing the contents of the container;

a skirt (3) depending from the upper part (2) and having means (4) for fixing the cap onto a neck (5) of a container, a lid (15) connected to the upper part by at least one hinge (16) in order to be movable between open and closed positions of the dispensing orifice (10);

a tamper-evident band (25) which is joined to the upper part (2) of the cap by at least two frangible straps (30, 32) each having a zone of least resistance for rupture, and which defines a hooking edge (26) in the closed position of the orifice for receiving a hook (27) carried by the lid (15), characterised in that the lid includes means (35) additional to and separate from the hook and cooperating with the hook for retaining and holding the tamper-evident band (25) against the lid (15) in the closed position of the orifice (11) to prevent manipulation of the band and thereby prevent opening of the lid without rupture of the straps.

2. Cap according to claim 1, characterised in that the retaining means comprise at least one tab (45), which fits a part of the edge of the tamper-evident band.

3. Cap according to claim 1, characterised in that the tamper-evident band (15) has a notch (40) on a level with the hooking edge (26).

4. Cap according to claim 1, characterised in that the tamper-evident band (25) includes a window (47) one edge of which defines the hooking edge (26) for the hook (27) of the lid (15).

5. A cap with a dispensing orifice for closing a neck (5) of a container (6) comprising:

an upper part (2) having a dispensing orifice (10) for dispensing the contents of a container;

a skirt (3) depending from the upper part (2) and having means (4) for fixing the cap onto a neck (5) of a container, a lid (15) connected to the upper part by at least one hinge (16) in order to be movable between open and closed positions of the dispensing orifice (10);

a tamper-evident band (25) which is joined to the upper part (2) of the cap by at least two frangible straps (30, 32) each having a zone of least resistance for rupture, and which defines a hooking edge (26) in the closed position of the orifice for receiving a hook (27) carried by the lid (15), characterised in that the lid includes means (35) for retaining the tamper-evident band (25) against the lid (15) in the closed position of the orifice (11) to prevent manipulation of the band and thereby prevent opening of the lid without rupture of the straps, and the retaining means (35) is adapted to receive at least part of an edge (36) of the band (25) situated opposite the hooking edge (26) in order to retain the tamper-evident band (25) on the lid (15) after a rupture of the straps following a first opening of the lid (10).

6. Cap according to claim 5, characterised in that the retaining means (35) comprise at least one seat (37) for receiving at least part of the tamper-evident band (25) in order, in association with the hook of the lid (27), to hold the tamper-evident band (25) on the lid after a rupture of the straps following a first opening of the cap.

7. Cap according to claim 5, characterised in that the retaining means (35) comprise at least one groove (46) designed to receive at least part of an edge (36) of the tamper-evident band (25), situated opposite the hooking edge (36) when the hook (27) of the lid is engaged under the hooking edge (26).

8. Cap according to claim 5, characterised in that the retaining means comprise at least one tab (45), which fits a part of the edge of the tamper-evident band.

9. A cap with a dispensing orifice for closing a neck (5) of a container (6) comprising:

an upper part (2) having a dispensing orifice (10) for dispensing the contents of a container;

a skirt (3) depending from the upper part (2) and having means (4) for fixing the cap onto a neck (5) of a container, a lid (15) connected to the upper part by at least one hinge (16) in order to be movable between open and closed positions of the dispensing orifice (10);

a tamper-evident band (25) which is joined to the upper part (2) of the cap by at least two frangible straps (30, 32) each having a zone of least resistance for rupture, and which defines a hooking edge (26) in the closed position of the orifice for receiving a hook (27) carried by the lid (15), characterised in that the lid includes means (35) for retaining the tamper-evident band (25) against the lid (15) in the closed position of the orifice (11) to prevent manipulation of the band and thereby prevent opening of the lid without rupture of the straps, and the retaining means (35) comprise at least one seat (37) for receiving at least part of the tamper-evident band (25) in order, in association with the hook of the lid (27), to hold the tamper-evident band (25) on the lid after a rupture of the straps following a first opening of the cap.

10. Cap according to claim 9, characterised in that the retaining means (35) comprise two seats (37, 38) situated on either side of the hook (27) and each designed to receive an end (39) of the tamper-evident band (25).

11. Cap according to claim 10, characterised in that the two seats (37, 38) each fit a part of the edge of the band situated adjacent the hooking edge and an extreme edge of the tamper-evident band.

12. A cap with a dispensing orifice for closing a neck (5) of a container (6) comprising:

an upper part (2) having a dispensing orifice (10) for dispensing the contents of a container;

a skirt (3) depending from the upper part (2) and having means (4) for fixing the cap onto a neck (5) of a container, a lid (15) connected to the upper part by at least one hinge (16) in order to be movable between open and closed positions of the dispensing orifice (10);

a tamper-evident band (25) which is joined to the upper part (2) of the cap by at least two frangible straps (30, 32) each having a zone of least resistance for rupture, and which defines a hooking edge (26) in the closed position of the orifice for receiving a hook (27) carried by the lid (15), characterised in that the lid includes means (35) for retaining the tamper-evident band (25) against the lid (15) in the closed position of the orifice (11) to prevent manipulation of the band and thereby prevent opening of the lid without rupture of the straps, and the retaining means (35) comprise at least one groove (46) designed to receive at least part of an edge (36) of the tamper-evident band (25), situated opposite the hooking edge (36) when the hook (27) of the lid is engaged under the hooking edge (26).

13. A cap with a dispensing orifice for closing a neck (5) of a container (6) comprising:

an upper part (2) having a dispensing orifice (10) for dispensing the contents of a container;

a skirt (3) depending from the upper part (2) and having means (4) for fixing the cap onto a neck (5) of a container, a lid (15) connected to the upper part by at least one hinge (16) in order to be movable between open and closed positions of the dispensing orifice (10);

a tamper-evident band (25) which is joined to the upper part (2) of the cap by at least two frangible straps (30, 32) each having a zone of least resistance for rupture, and which defines a hooking edge (26) in the closed position of the orifice for receiving a hook (27) carried by the lid (15), characterised in that the lid includes means (35) for retaining the tamper-evident band (25) against the lid (15) in the closed position of the orifice (11) to prevent manipulation of the band and thereby prevent opening of the lid without rupture of the straps, and the tamper-evident band includes a notch (40) arranged in the edge of the band situated opposite the hooking edge.

* * * * *